US006450901B1

(12) United States Patent
Binette et al.

(10) Patent No.: US 6,450,901 B1
(45) **Date of Patent: *Sep. 17, 2002**

(54) GOLF BALL HAVING IMPROVED HEAT RESISTANCE

(75) Inventors: Mark L. Binette, Ludlow; Thomas J. Kennedy, III, Wilbraham; John T. Neill, Westfield, all of MA (US)

(73) Assignee: Spalding Sports Worldwide, Inc., Chicopee, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/235,252

(22) Filed: Jan. 22, 1999

(51) Int. Cl.[7] ..... A63B 37/12
(52) U.S. Cl. ..... 473/378; 473/377
(58) Field of Search ..... 473/376, 374, 473/384, 378, 377

(56) References Cited

U.S. PATENT DOCUMENTS

| | | | | |
|---|---|---|---|---|
| 4,431,193 A | | 2/1984 | Nesbitt | |
| 4,679,795 A | | 7/1987 | Melvin et al. | |
| 4,838,556 A | | 6/1989 | Sullivan | |
| 4,844,471 A | | 7/1989 | Terence et al. | |
| 4,852,884 A | | 8/1989 | Sullivan | |
| 4,884,814 A | * | 12/1989 | Sullivan | 473/376 |
| 4,911,451 A | | 3/1990 | Sullivan et al. | |
| 4,919,434 A | * | 4/1990 | Saito | 473/376 |
| 5,452,898 A | * | 9/1995 | Yamagishi et al. | 473/376 |
| 5,538,794 A | * | 7/1996 | Cadorniga et al. | 473/378 |
| 5,688,869 A | * | 11/1997 | Sullivan | 473/376 |
| 5,702,312 A | * | 12/1997 | Horiuchi et al. | 473/384 |
| 5,816,943 A | * | 10/1998 | Masutani et al. | 473/377 |
| 5,857,925 A | * | 1/1999 | Sullivan et al. | 473/374 |

* cited by examiner

*Primary Examiner*—Mark S. Graham
*Assistant Examiner*—Raeann Gorden

(57) ABSTRACT

Disclosed herein is a golf ball and method for making the same. The golf ball has an ionomeric cover which includes a high melt ionomer having a Vicat softening temperature of 74° C. or more (preferably 80° C. or more, more preferably, 84° C. or more) and a melt temperature of 96° C. or more (preferably 98° C. or more, and most preferably 100° C. or more). Additionally, the high melt ionomer utilized in the invention exhibits a difference in melt temperature and Vicat temperature of 25° C. or less (preferably 19° C. or less, more preferably, 17° C. or less). The golf ball cover is superior in heat resistance to a conventional cover but is otherwise substantially identical in composition.

18 Claims, 1 Drawing Sheet

GOLF BALL HAVING IMPROVED HEAT RESISTANCE

FIELD OF THE INVENTION

This invention relates generally to golf balls, and specifically to ionomer covered golf balls (more preferably, soft ionomer covered golf balls) having improved heat resistance. These golf balls exhibit improved melt resistance and heat stability when subject to high temperatures, i.e. 50° C. or more. Such high temperatures can be present in the trunks and/or interiors of automobiles, shipping containers, truck trailers, warehouses, etc., in warm climates and/or on hot summer days. The golf balls of the invention exhibit improved heat stability without sacrificing such properties as distance, durability and/or playability.

BACKGROUND OF THE INVENTION

Before the development of ionomers, balata was the preferred material of formulations for golf ball covers. Polyethylene also was proposed for use as a golf ball cover material but was generally deemed highly inferior to balata in imparting playability and durability characteristics to the ball due to its brittleness and high hardness, and thus never became a commercially successful golf ball cover material.

Balata golf ball covers have now been replaced to a great extent by ionomeric cover materials. As a result of their toughness, durability, and flight characteristics, various ionomeric resins sold by E.I. DuPont deNemours & Company (see U.S. Pat. No. 4,884,814) under the trademark "Surlyn®" and more recently, by the Exxon Corporation (see U.S. Pat. No. 4,911,451) under the trademarks "Escor® and the tradename "lotek", have become the materials of choice for the construction of golf ball covers over the traditional "balata" (trans polyisoprene, natural or synthetic) rubbers. The softer balata covers, although exhibiting enhanced playability properties, lack the overall durability necessary for repetitive play.

Ionomeric resins are generally ionic copolymers or terpolymers of an olefin such as ethylene and a metal salt of an unsaturated carboxylic acid, such as acrylic acid, methacrylic acid, or maleic acid. Optionally, an acrylate can also be present. Metal ions, such as sodium or zinc, are used to neutralize some portion of the acidic groups in the copolymer resulting in a thermoplastic elastomer exhibiting enhanced properties, i.e. improved durability, etc., for golf ball cover construction over balata.

In this regard, the metal ions serve as crosslinking agents, as they are ionically bonded to carboxylic acid groups in adjacent copolymer chains. However, instead of having thermally irreversible covalent bonding, ionomers have thermolabile crosslinking in which metal ions become part of the chemical structure of the ionomer upon crosslinking, and these crosslinks are reversible. Consequently, at high temperatures ionomers are subject to distortion or degradation.

Furthermore, the advantages gained through the use of ionomer resins in golf ball cover formulations in increased durability have been offset to some degree by the decreases produced in playability. This is because although the ionomeric resins are very durable, they tend to be very hard when utilized for golf ball cover construction, and thus lack the degree of softness required to impart the spin necessary to control the ball in flight.

As a result, while there are currently more than fifty commercial grades of ionomers available from DuPont and Exxon with a wide range of properties which vary according to the type and amount of metal cations, molecular weight, composition of the base resin (i.e. relative content of ethylene and methacrylic and/or acrylic acid groups) and additive ingredients such as reinforcements, etc., a great deal of research continues in order to develop golf ball cover compositions exhibiting not only the improved impact resistance and carrying distance properties produced by the "hard" ionomeric resins, but also the playability (i.e. "spin") characteristics previously associated with the "soft" balata covers, properties which are still desired by the more skilled golfer.

In various attempts to produce such an ideal golf ball, the golfing industry has blended the hard ionomeric resins with a number of softer polymeric materials, such as softer polyurethanes. However, the blends of the hard ionomer resins with the softer polymeric materials have generally been dissatisfactory in that these balls exhibit numerous processing problems. In addition, the balls produced by such a combination are usually short on distance.

In addition, various "hard-soft ionomeric blends", i.e. mixtures of ionomer resins which are significantly different in hardness and/or flexural modulus, have been attempted. However, until the development of the specific blend combination set forth in U.S. Pat. No. 4,884,814, directed to low modulus golf ball cover compositions, these balls were not particularly commercially viable. In this regard, although the balls produced using the hard-soft ionomer blends exhibited enhanced playability characteristics, they lacked the durability needed for continuous play.

Moreover, while there are numerous advantages to the use of ionomers in making golf ball covers, one drawback of conventional golf balls with ionomeric covers are that the covers are prone to softening at temperatures of approximately 50° C. or above. As a result, the ionomeric covers (and in particular, soft ionomeric covers) may lose their dimple pattern or develop flat spots if exposed to high temperatures.

Accordingly, it would be useful to develop a golf ball with an ionomeric cover which is highly resistant to high temperature distortion or degradation without sacrificing the properties of distance, durability and/or playability.

Furthermore, it would be useful to improve the heat resistance of soft ionomeric golf ball covers without substantially hardening the covers. This would result in the production of a soft ionomer covered golf ball having the distance, durability and/or playability characteristics desired while also being resistant to degradation at high temperatures.

SUMMARY OF THE INVENTION

The present invention relates to new and improved golf balls which overcome the above referenced problems and others. In this regard, the present invention is directed to golf balls having improved heat and/or melt resistance. This enables the golf balls to withstand prolonged exposure to heat during use or storage.

Another object of the invention is to provide a method for improving the heat and/or melt resistance of a golf ball cover. The invention is directed to any type of ionomer covered golf ball including unitary, wound, two-piece, three-piece and multi-layered golf balls.

Yet another object of the invention is to provide a golf ball with a soft ionomer cover which is well-suited for repetitive play and exhibits improved heat and/or melt resistance when subject to high temperatures, i.e. 50° C. or more.

Another object of the invention is to provide a golf ball with a very soft ionomeric cover having enhanced heat stability and/or improved heat and melt resistance. These golf balls also exhibit the feel and playability characteristics that highly-skilled golfers prefer. This enables the soft covered golf balls to exhibit enhanced dimple retention during prolonged exposure to high temperatures.

Other objects will be in part obvious and in part pointed out more in detail hereinafter.

In accordance with the present invention, there is provided a golf ball, comprising a core and a dimpled cover having a Shore D hardness of 63 or less as measured on a non-dimpled portion of the cover, the dimples maintaining their shape when the cover is subjected to prolonged heat exposure at 160–180° F. (71–82° C.) for at least one hour.

The core component of the invention can consist, if present, of a solid or wound core. Additionally, the core can consist of one or more layers. Similarly, the cover component of the golf ball can consist of one or more layers. However, the outer layer of the golf ball is comprised of an ionomer based material.

More particularly, the outer cover is a blend of one or more ionomer copolymers and/or terpolymers and one or more ionomers having-a high Vicat softening temperature. Preferably, the high Vicat softening temperature ionomer also has a high melt temperature. More preferably, the difference between the high melt temperature and the Vicat softening temperature of the high melt ionomer is minimized. It has been found that such high melt ionomers act as good heat stability modifiers for ionomer covers, and in particular, for soft ionomer covered golf balls.

Along these lines, the Vicat softening temperature of the high melt ionomer incorporated into the present invention is 74° C. or more, preferably 80° C. or more, and most preferably, 84° C. or more. The melt temperature of the high melt ionomer is 96° C. or more, preferably 98° C. or more, and most preferably, 100° C. or more. Furthermore, the high melt ionomer utilized in the invention exhibits a difference in melt temperature and Vicat temperature of 25° C., more preferably 19° C. or less, most preferably 17° C. or less.

Additionally, the high melt ionomer of the present invention can also be utilized to formulate that inner cover layer or mantle of a multi-layer golf ball. Accordingly, one or more of the ionomer layers of a multi-layer golf ball can exhibit high heat stability.

The dimpled cover golf ball of the present invention preferably has a Shore D hardness cover of 63 or less, preferably 55 or less, and most preferably 50 or less. The dimpled cover is formed from a cover material which comprises at least 80 parts by weight of copolymer or terpolymer ionomer (preferably 80–97, most preferably 91–94) and 3–20 parts by weight of high melt ionomer (preferably 3–20, most preferably 6–9).

These and other objects and features of the invention will be apparent from the following descriptions and from the claims.

BRIEF DESCRIPTION OF THE DRAWINGS

The following is a brief description of the drawings which are presented for the purposes of illustrating the invention and not for the purposes of limiting the same.

DETAILED DESCRIPTION OF THE INVENTION

The golf balls of the present invention are surprisingly superior in their heat resistance to conventional golf balls which contain similar quantities of ionomer and have a similar hardnesses. Furthermore, the golf balls of the invention are comparable in heat resistance to golf balls having non-ionomeric compositions, such as polyurethanes, with similar properties of compression, coefficient of restitution (C.O.R.) and hardness.

Along this line, any noticeable loss in dimple depth of a golf ball due to heat exposure is unacceptable. The present invention is directed to the prevention of such a loss. This is particularly true with golf balls having a relatively soft outer cover layer. Such an outer cover layer has a plaque Shore D hardness (ASTM D-2240) in the range of 30–63, more preferably 35–55, and most preferably 40–50. In this regard, It has been found that the heat resistance of such an outer cover can be increased through the use of the present invention. This enables the soft covered golf balls to withstand prolonged exposure to heat during use or storage.

Figure 1:
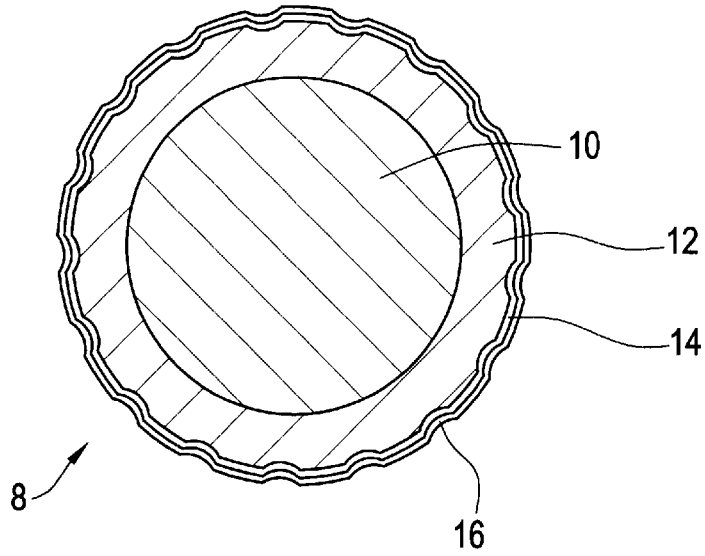
FIG. 1 shows a golf ball according to the present invention.

Referring now to the drawings, and in particular to FIG. 1, a golf ball according to the present invention is shown and is designated as 8. The ball has a core 10, which is solid, or is formed from any other suitable type of core material. An ionomeric cover 12 surrounds the core 10 to form an unfinished two piece golf ball. A thin primer coat 14 is applied to the outer surface of cover 12. A thin top coat 16 surrounds the primer coat 14 to form a finished golf ball. The thicknesses of primer coat 14 and top coat 16 are exaggerated for illustrative purposes.

The ionomeric cover 12 comprises a blend of one or more soft or hard ionomer copolymers and/or terpolymers and one or more ionomers having a high Vicat softening temperature. Preferably the high Vicat softening temperature ionomer also has a high melt temperature. Such ionomers are referred to herein as "high melt ionomers". Additionally, more optimal results have been found when the difference between the high melt temperature and the Vicat softening temperature of the high melt ionomer is minimized.

Particularly preferred soft and/or hard ionomers or ionomer blends utilized in the invention include ionic copolymers containing an olefin, an unsaturated carboxylic acid, and optionally, an acrylate. Such polymers typically, although not necessarily, have a Shore D hardness in the range of 20–60.

The soft (low modulus) ionomers utilized to formulate the blends of the present invention may be generally characterized as being comprised of metal salts of a copolymer or terpolymer of an olefin having from about 2 to 8 carbon atoms, acrylic or methacrylic acid, and optionally an unsaturated monomer of the acrylate ester class having from 2 to 22 carbon atoms.

The soft (low modulus) ionomers have a hardness from about 20 to about 40 (preferably from about 30 to about 40) as measured on the Shore D scale and a flexural modulus from about 2,000 to about 10,000 psi (preferably from about 3,000 to 7,000 psi) as measured in accordance with ASTM method D-790.

More particularly, it has been found that if one or more the relatively new acrylic acid based soft ionomers previously developed by the Exxon Corporation for the Spalding Sports Worldwide, Inc. are utilized with the specific high Vicat softening and/or high melt temperature ionomers described below (and in the combinations more clearly defined below and demonstrated in the Examples), improvements in processability and clarity seen. In addition, the overall combinations, when utilized for golf ball construction, produce golf balls exhibiting enhanced heat stability and having higher coefficient of restitution values (i.e. longer distance)

at equal or softer hardness than golf balls produced by other known hard-soft ionomer blends.

In this regard, it has been found that when the ethylene-acrylic acid based soft ionomer resins developed by the Exxon Corporation under the designations "lotek 7520" (referred experimentally by differences in neutralization and melt indexes as LDX 195, LDX 196, LDX 218 and LDX 219) and "lotek 7510" are optionally combined with known hard ionomers (such as those indicated below) the combination produces higher C.O.R.s at equal or softer hardness, higher melt flow as well as improved heat resistance.

Exxon's Experimental Product Data sheet lists the following physical properties of ethylene-acrylic acid zinc ionomer developed by Exxon and sold under the designation lotek 7520:

| Property | ASTM Method | Units | Typical Value |
|---|---|---|---|
| Physical Properties of Iotek 7520 | | | |
| Melt Index | D-1238 | g/10 min. | 2 |
| Density | D-1505 | $kg/m^3$ | 0.962 |
| Cation | | | Zinc |
| Melting Point | D-3417 | ° C. | 66 |
| Crystallization Point | D-3417 | ° C. | 49 |
| Vicat Softening Point | D-1525 | ° C. | 42 |
| Plaque Properties (2 mm thick Compression Molded Plaques) | | | |
| Tensile at Break | D-638 | Mpa | 10 |
| Yield Point | D-638 | Mpa | None |
| Elongation at Break | D-638 | % | 760 |
| 1% Secant Modulus | D-638 | Mpa | 22 |
| Shore D Hardness | D-2240 | | 32 |
| Flexural Modulus | D-790MPa | | 26 |
| Zwick Rebond | ISO 4862 | % | 52 |
| De Mattia Flex Resistance | D-430 | Cycles | >5000 |

In addition, collected information indicates that lotek 7520 resins have Shore D hardnesses of about 32–36 (per ASTM D-2240), melt flow indexes of 3±0.5 g/10 min (at 190° C. per ASTM D-1288), a flexural modulus of about 2500–3500 psi (per ASTM D-790). Furthermore, testing by an independent testing laboratory by pyrolysis mass spectrometry indicates that the lotek 7520 resins are generally zinc salts of a terpolymer of ethylene, acrylic acid, and methyl acrylate.

Furthermore, it has been found that a fairly recently developed grade of an acrylic acid based soft ionomer available from the Exxon Corporation under the designation lotek 7510, is also effective, when combined with the ionomers exhibiting high melt temperatures and/or high Vicat softening temperatures in producing golf ball covers exhibiting improved heat resistance and higher C.O.R. values at equal or softer hardness than those produced by known hard-soft ionomer blends.

In addition, lotek 7510, when compared to lotek 7520, produces slightly higher C.O.R. valves at equal softness/hardness due to the lotek 7510's higher hardness and neutralization. Similarly, lotek 7510 produces better release properties (from the mold cavities) due to its slightly higher stiffness and lower flow rate than lotek 7520. This is important in production where the soft covered balls tend to have lower yields caused by sticking in the molds and subsequent punched pin marks from the knockouts.

According to Exxon, lotek 7510 is of similar chemical composition as lotek 7520 (i.e. a zinc salt of a terpoloymer of ethylene, acrylic acid, and methyl acrylate) but is more highly neutralized. Based upon FTIR analysis, lotek 7520 is estimated to be about 30–40 wt.-% neutralized and lotek 7510 is estimated to be about 40–60 wt.-% neutralized. The typical properties of lotek 7510 in comparison of those of lotek 7520 are set forth below:

Physical Properties of Iotek 7510 in Comparison to Iotek 7520

| | IOTEK 7520 | IOTEK 7510 |
|---|---|---|
| Ml, g/10 min | 2.0 | 0.8 |
| Density, g/cc | 0.96 | 0.97 |
| Melting Point, ° F. | 151 | 149 |
| Vicat Softening Point, ° F. | 108 | 109 |
| Flex Modulus, psi | 3800 | 5300 |
| Tensile Strength, psi | 1450 | 1750 |
| Elongation, % | 760 | 690 |
| Hardness, Shore D | 32 | 35 |

In addition to the recently developed ethylene-acrylic acid based soft ionomers (i.e. the lotek 7520 and the lotek 7510 resins) set forth above, other known soft ionomers can be utilized in the present invention. For example, the soft Surlyn® ionomers (i.e. the Surlyn® 8265 and 8269 resins) can also be utilized. These are of the poly(ethylene-methacrylic acid-butyl acrylate) type. The properties of these ionomers are set forth below:

| PROPERTY | SURLYN ® 8265/8120 | SURLYN ® 8269/8320 |
|---|---|---|
| Melt Index | 0.9 gm/10[1] | 0.9 gm/10[1] |
| Density | 0.94 | 0.94 |
| Cation | Na | Na |
| Melting Point | 81° C. | 72° C. |
| Crystallization Point | 51° C. | 38° C. |
| Vicat Softening Point | 51° C. | 48° C. |

Optionally, one or more hard ionomers may be included in the present invention. The hard (high modulus) ionomers suitable for use in the present invention include those ionomers having a hardness greater than 50 on the Shore D scale as measured in accordance with ASTM method D-2240, and a flexural modulus from about 15,000 to about 70,000 psi as measured in accordance with ASTM method D-790.

The hard ionomer resins utilized to produce the cover compositions are ionic copolymers which are the sodium, zinc, magnesium or lithium salts of the reaction product of an olefin having from 2 to 8 carbon atoms and an unsaturated monocarboxylic acid having from 3 to 8 carbon atoms. The carboxylic acid groups of the copolymer may be totally or partially (i.e. approximately 15–75 percent) neutralized.

Preferably, the hard ionomeric resins are copolymers of ethylene and either acrylic and/or methacrylic acid, with copolymers of ethylene and acrylic acid the most preferred. In addition, two or more types of hard ionomeric resins may be blended into the cover compositions in order to produce the desired properties of the resulting golf balls.

Examples of commercially available hard ionomeric resins which may be utilized in the present invention include the hard sodium ionic copolymer sold under the trademark "Surlyn® 8940" and the hard zinc ionic copolymer sold under the trademark "Surlyn® 9910". Surlyn® 8940 is a copolymer of ethylene with methacrylic acid with about 15 weight percent acid which is about 29% neutralized with sodium ions.

This resin has an average melt flow index of about 2.8. Surlyn® 9910 is a copolymer of ethylene and methacrylic acid with about 15 weight percent acid which is about 58% neutralized with zinc ions. The average melt flow index of Surlyn® 9910 is about 0.7. The typical properties of Surlyn® 9910 and 8940 are set forth below.

The ionomers incorporated into the present invention to produce the improved heat stability are those ionomers which have a high Vicat softening temperature (ASTM D 1525). The Vicat softening temperature of the high melt ionomer included in the invention has a Vicat softening temperature of 74° C. or more, preferably 80° C. or more, and most preferably, 84° C. or more.

Typical Properties of Commercially Available Hard Surlyn ® Resins Suitable for Use in the Present Invention

| | ASTM D | 8940 | 9910 | 8920 | 8528 | 9970 | 9730 |
|---|---|---|---|---|---|---|---|
| Cation Type | | Sodium | Zinc | Sodium | Sodium | Zinc | Zinc |
| Melt flow index, gms/10 min. | D-1238 | 2.8 | 0.7 | 0.9 | 1.3 | 14.0 | 1.6 |
| Specific Gravity, g/cm$^3$ | D-792 | 0.95 | 0.97 | 0.95 | 0.94 | 0.95 | 0.95 |
| Hardness, Shore D | D-2240 | 66 | 64 | 66 | 60 | 62 | 63 |
| Tensile Strength, (kpsi), MPa | D-638 | (4.8) | (3.6) | (5.4) | (4.2) | (3.2) | (4.1) |
| | | 33.1 | 24.8 | 37.2 | 29.0 | 22.0 | 28.0 |
| Elongation, % | D-638 | 470 | 290 | 350 | 450 | 460 | 460 |
| Flexural Modulus, (kpsi) MPa | D-790 | (51) | (48) | (55) | (32) | (28) | (30) |
| | | 350 | 330 | 380 | 220 | 190 | 210 |
| Tensile Impact (23° C.) | D-18225 | 1020 | 1020 | 865 | 1160 | 760 | 1240 |
| KJ/m$_2$ (ft. – lbs./in$^2$) | | (485) | (485) | (410) | (550) | (360) | (590) |
| Vicat Temperature, ° C. | D-1525 | 63 | 62 | 58 | 73 | 61 | 73 |

In addition, examples of the more pertinent acrylic acid based hard ionomer resins suitable for use in the present invention sold under the "lotek" tradename by the Exxon Corporation include "lotek 4000" (formerly "Escor 4000"), "lotek 4010", "lotek 8000" (formerly Escor 900), "lotek 8020", and "lotek 8030". The typical properties of the lotek hard ionomers are set forth below.

Preferably the high melt ionomer included also has a high melt temperature (ASTM D 3417). The melt temperature of the high melt ionomer included in the invention has a high melt temperature of 96° C. or more, preferably 98° C. or more and most preferably, 100° C. or more.

Typical Properties of Iotek Ionomers

| | | ASTM Method | Units | 4000 | 4010 | 8000 | 8020 | 8030 |
|---|---|---|---|---|---|---|---|---|
| Resin Properties | | | | | | | | |
| Cation type | | | | zinc | zinc | sodium | sodium | sodium |
| Melt index | | D-1238 | g/10 min. | 2.5 | 1.5 | 0.8 | 1.6 | 2.8 |
| Density | | D-1505 | kg/m$^3$ | 963 | 963 | 954 | 960 | 960 |
| Melting Point | | D-3417 | ° C. | 90 | 90 | 90 | 87.5 | 87.5 |
| Crystallization Point | | D-3417 | ° C. | 62 | 64 | 56 | 53 | 55 |
| Vicat Softening Point | | D-1525 | ° C. | 62 | 63 | 61 | 64 | 67 |
| % Weight Acrylic Acid | | | | 16 | | 11 | | |
| % of Acid Groups cation neutralized | | | | 30 | | 40 | | |
| Plaque Properties (3 mm thick, compression molded) | | | | | | | | |
| Tensile at break | | D-638 | MPa | 24 | 26 | 36 | 31.5 | 28 |
| Yield point | | D-638 | MPa | none | none | 21 | 21 | 23 |
| Elongation at break | | D-638 | % | 395 | 420 | 350 | 410 | 395 |
| 1% Secant modulus | | D-638 | MPa | 160 | 160 | 300 | 350 | 390 |
| Shore Hardness D | | D-2240 | — | 55 | 55 | 61 | 58 | 59 |
| Film Properties (50 micron film 2.2:1 Blow-up ratio) | | | | | | | | |
| Tensile at Break | MD | D-882 | MPa | 41 | 39 | 42 | 52 | 47.4 |
| | TD | D-882 | MPa | 37 | 38 | 38 | 38 | 40.5 |
| Yield point | MD | D-882 | MPa | 15 | 17 | 17 | 23 | 21.6 |
| | TD | D-882 | MPa | 14 | 15 | 15 | 21 | 20.7 |
| Elongation at Break | MD | D-882 | % | 310 | 270 | 260 | 295 | 305 |
| | TD | D-882 | % | 360 | 340 | 280 | 340 | 345 |
| 1% Secant modulus | MD | D-882 | MPa | 210 | 215 | 390 | 380 | 380 |
| | TD | D-882 | MPa | 200 | 225 | 380 | 350 | 345 |
| Dart Drop Impact | | D-1709 | g/micron | 12.4 | 12.5 | 20.3 | | |

Additionally, it has also been found that the preferred high melt ionomer incorporated into the invention exhibits a difference in melt temperature and Vicat softening temperature of 25° C. or less, preferably 17° C. or less. It has been found that these high melt ionomers act as beneficial heat stability modifiers in ionomer cover compositions.

An example of such a high melt ionomer is Surlyn® 8549 recently made experimentally available from DuPont. According to DuPont, Surlyn® 8549 possesses the following general characteristics:

| Properties of Surlyn ® 8549 | Units | Typical Value |
|---|---|---|
| Ion | | Na |
| Melt Flow Index | 190/2.16 kg | 2.3 |
| Melting Point | 0° C. | 101 |
| Vicat Temperature | 0° C. | 84 |
| Tensile Strength | MPa | 32 |
| Elongation at Break | % | 300 |
| Flex Modulus | MPa | 390 |
| Haze | % | 4 |
| Elmendorf Tear | g/25$\mu$ | 34 |

Additionally, Surlyn® 8549 is distinguishable from other high melt ionomer resins as follows:

A. Physical Property Comparison

| | Surlyn ® 8549 | Iotek 8610 | Iotek 8000 | Surlyn ® 8940 | Surlyn ® 8527 | Surlyn ® 8660 |
|---|---|---|---|---|---|---|
| Melt index (g/10 min) | 2.3 | 1.3 | 0.8 | 2.8 | 1 | 10 |
| Melt temperature (° C.) | 100 | 86 | 83 | 94 | 93 | 95 |
| Vicat Softening temperature (° C.) | 84 | 57 | 54 | 63 | 73 | 71 |
| Tensile strength (MPa) | 32 | 34 | 33 | 33 | 29 | 23.4 |
| Elongation (%) | 300 | 420 | 370 | 470 | 450 | 470 |
| Flex modulus (MPa) | 390 | 290 | 320 | 350 | 220 | 230 |
| haze (%) | 4 | | 5 | 5 | 6 | 11 |
| Shore D | 61 | 58 | 60 | 65 | 60 | 62 |

B. Differential Scanning Calorimeter Comparisons

| Grade | $T_c$ (° C.) | $T_m$ (° C.) | $T_m - T_c$ (° C.) |
|---|---|---|---|
| Iotek 8000 | 43.8 | 85 | 41.2 |
| Surlyn 8660 | 60.7 | 96.9 | 35.9 |
| Surlyn 8940 | 54.6 | 91.8 | 37.2 |
| Iotek 8000 | 42.9 | 84.9 | 42 |
| EX 1002 | 43.66 | 82.5 | 38.9 |
| AD 8549 | 64.7 | 99.4 | 34.7 |

In addition to the above, non-ionomeric materials can also be blended with the ionomers as long as an acceptable increase in heat resistance is obtained as a result of the inclusion of an ionomer having a high melt temperature and/or high Vicat softening temperature. Non-limiting examples of materials to be blended with an ionomer include ethylene-ethyl acrylate, ethylene-methyl acrylate, ethylene-vinyl acetate, low density polyethylene, linear low density polyethylene, metallocene catalyzed polyolefins such as ENGAGE polyolefins available from Dow Chemical and EXACT polyolefins available from Exxon, non-ionomeric acid copolymers such as PRIMACOR, available from Dow Chemical, and NUCREL, available from DuPont, and a variety of thermoplastic elastomers, including KRATON, available from Shell, SANTOPRENE, available from Monsanto, and HYTREL, available from DuPont, etc. Furthermore functionalized EPDM, such as maleated EPDM, nylon, and nylon-ionomer graft copolymers can be blended with the ionomer.

Additional materials may also be added to the compositions of the present invention, including dyes (for example, Ultramarine Blue sold by Whitaker, Clark, and Daniels of South Plainsfield, N.J.) (see U.S. Pat. No. 4,679,795), pigments such as titanium dioxide, zinc oxide, barium sulfate and zinc sulfate; UV absorbers; antioxidants; antistatic agents; and stabilizers. Moreover, the cover compositions of the present invention may also contain softening agents, such as plasticizers, processing aids, etc., and reinforcing materials such as glass fibers and inorganic fillers, as long as the desired properties produced by the golf ball covers of the invention are not impaired.

The cover compositions of the present invention may be produced according to conventional melt blending procedures. Generally, the soft ionomer resins are blended with the hard ionomeric resins (if so desired) in a Banbury type mixer, two-roll mill, or extruder prior to molding. The blended composition is then formed into slabs and maintained in such a state until molding is desired. If necessary, further additives such as inorganic fillers, antioxidants, stabilizers, and/or zinc oxide may be added and uniformly mixed before initiation of the molding process.

The golf balls of the present invention can be produced by molding processes currently well known in the golf ball art. Specifically, the golf balls can be produced by injection molding or compression molding the novel cover compositions about wound or solid molded cores to produce a golf ball having a diameter of about 1.680 to about 1.800 inches and weighing about 1.620 ounces. The standards for both the minimum diameter and maximum weight of the balls have been established by the United States Golf Association (U.S.G.A.).

Although both solid core and wound cores can be utilized in the present invention, as a result their lower cost and superior performance, solid molded cores are preferred over wound cores.

The term "solid cores" as used herein refers not only to one piece cores but also to those cores having a separate solid layer beneath the cover and above the core as in U.S. Pat. No. 4,431,193, and other multi-layer and/or non-wound cores.

The specially produced core compositions and resulting molded cores of the present invention are manufactured using relatively conventional techniques. In this regard, the core compositions of the invention may be based on polybutadiene, and mixtures of polybutadiene with other elastomers. It is preferred that the base elastomer have a relatively high molecular weight. The broad range for the molecular weight of suitable base elastomers is from about 50,000 to about 500,000. A more preferred range for the molecular weight of the base elastomer is from about 100,000 to about 500,000. As a base elastomer for the core composition, cis-polybutadiene is preferably employed, or a blend of cis-polybutadiene with other elastomers may also be utilized. Most preferably, cis-polybutadiene having a weight- average molecular weight of from about 100,000 to about 500,000 is employed. Along this line, it has been found that the high cis-polybutadiene manufactured and sold by Shell Chemical Co., Houston, Tex., under the tradename Cariflex BR-1220, and the polyisoprene available from Muehlstein, H & Co., Greenwich, Connecticut under the designation "SKI 35" are particularly well suited.

The unsaturated carboxylic acid component of the core composition (a co-crosslinking agent) is the reaction product of the selected carboxylic acid or acids and an oxide or carbonate of a metal such as zinc, magnesium, barium, calcium, lithium, sodium, potassium, cadmium, lead, tin, and the like. Preferably, the oxides of polyvalent metals such as zinc, magnesium and cadmium are used, and most preferably, the oxide is zinc oxide.

Exemplary of the unsaturated carboxylic acids which find utility in the present core compositions are acrylic acid, methacrylic acid, itaconic acid, crotonic acid, sorbic acid, and the like, and mixtures thereof. Preferably, the acid component is either acrylic or methacrylic acid. Usually, from about 15 to about 25, and preferably from about 17 to about 21 parts by weight of the carboxylic acid salt, such as zinc diacrylate, is included in the core composition. The unsaturated carboxylic acids and metal salts thereof are generally soluble in the elastomeric base, or are readily dispersible.

The free radical initiator included in the core composition is any known polymerization initiator (a co-crosslinking agent) which decomposes during the cure cycle. The term "free radical initiator" as used herein refers to a chemical which, when added to a mixture of the elastomeric blend and a metal salt of an unsaturated, carboxylic acid, promotes crosslinking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides which are readily commercially available are conveniently used in the present invention, generally in amounts of from about 0.1 to about 10.0 and preferably in amounts of from about 0.3 to about 3.0 parts by weight per each 100 parts of elastomer.

Exemplary of suitable peroxides for the purposes of the present invention are dicumyl peroxide, n-butyl 4,4'-bis (butylperoxy) valerate, 1,1-bis(t-butylperoxy)-3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed.

Examples of such commercially available peroxides are Luperco 230 or 231 XL sold by Atochem, Lucidol Division, Buffalo, N.Y., and Trigonox 17/40 or 29/40 sold by Akzo Chemie America, Chicago, Ill. In this regard Luperco 230 XL and Trigonox 17/40 are comprised of n-butyl 4,4-bis (butylperoxy) valerate; and, Luperco 231 XL and Trigonox 29/40 are comprised of 1,1-bis(t-butylperoxy)-3,3,5-trimethyl cyclohexane. The one hour half life of Luperco 231 XL is about 112° C., and the one hour half life of Trigonox 29/40 is about 129° C.

The core compositions of the present invention may additionally contain any other suitable and compatible modifying ingredients including, but not limited to, metal oxides, fatty acids, and diisocyanates and polypropylene powder resin. For example, Papi 94, a polymeric diisocyanate, commonly available from Dow Chemical Co., Midland, Mich., is an optional component in the rubber compositions. It can range from about 0 to 5 parts by weight per 100 parts by weight rubber (phr) component, and acts as a moisture scavenger. In addition, it has been found that the addition of a polypropylene powder resin results in a core which is too hard (i.e. exhibits low compression) and thus allows for a reduction in the amount of crosslinking agent utilized to soften the core to a normal or below normal compression.

Furthermore, because polypropylene powder resin can be added to core composition without an increase in weight of the molded core upon curing, the addition of the polypropylene powder allows for the addition of higher specific gravity fillers, such as mineral fillers. Since the crosslinking agents utilized in the polybutadiene core compositions are expensive and/or the higher specific gravity fillers are relatively inexpensive, the addition of the polypropylene powder resin substantially lowers the cost of the golf ball cores while maintaining, or lowering, weight and compression.

The polypropylene ($C_3H_5$) powder suitable for use in the present invention has a specific gravity of about 0.90 g/cm$^3$, a melt flow rate of about 4 to about 12 and a particle size distribution of greater than 99% through a 20 mesh screen. Examples of such polypropylene powder resins include those sold by the Amoco Chemical Co., Chicago, Ill., under the designations "6400 P", "7000 P" and "7200 P". Generally, from 0 to about 25 parts by weight polypropylene powder per each 100 parts of elastomer are included in the present invention.

Various activators may also be included in the compositions of the present invention. For example, zinc oxide and/or magnesium oxide are activators for the polybutadiene. The activator can range from about 2 to about 30 parts by weight per 100 parts by weight of the rubbers (phr) component.

Moreover, filler-reinforcement agents may be added to the composition of the present invention. Since the specific gravity of polypropylene powder is very low, and when compounded, the polypropylene powder produces a lighter molded core, when polypropylene is incorporated in the core compositions, relatively large amounts of higher gravity fillers may be added so long as the specific core weight limitations are met. Additional benefits may be obtained by the incorporation of relatively large amounts of higher specific gravity, inexpensive mineral fillers such as calcium carbonate. Such fillers as are incorporated into the core compositions should be in finely divided form, as for example, in a size generally less than about 30 mesh and preferably less than about 100 mesh U.S. standard size. The amount of additional filler included in the core composition is primarily dictated by weight restrictions and preferably is included in amounts of from about 10 to about 100 parts by weight per 100 parts rubber.

The preferred fillers are relatively inexpensive and heavy and serve to lower the cost of the ball and to increase the weight of the ball to closely approach the U.S.G.A. weight limit of 1.620 ounces. However, if thicker cover compositions are to be applied to the core to produce larger than normal (i.e. greater than 1.680 inches in diameter) balls, use of such fillers and modifying agents will be limited in order to meet the U.S.G.A. maximum weight limitations of 1.620 ounces. Exemplary fillers include mineral fillers such as limestone, silica, micabarytes, calcium carbonate, or clays. Limestone is ground calcium/magnesium carbonate and is used because it is an inexpensive, heavy filler.

As indicated, ground flash filler may be incorporated and is preferably 20 mesh ground up center stock from the excess flash from compression molding. It lowers the cost and may increase the hardness of the ball.

Fatty acids or metallic salts of fatty acids may also be included in the compositions, functioning to improve moldability and processing. Generally, free fatty acids having from about 10 to about 40 carbon atoms, and preferably having from about 15 to about 20 carbon atoms, are used. Exemplary of suitable fatty acids are stearic acid and linoleic acids, as well as mixtures thereof. Exemplary of suitable metallic salts of fatty acids include zinc stearate. When included in the core compositions, the fatty acid component is present in amounts of from about 1 to about 25, preferably in amounts from about 2 to about 15 parts by weight based on 100 parts rubber (elastomer).

It is preferred that the core compositions include stearic acid as the fatty acid adjunct in an amount of from about 2 to about 5 parts by weight per 100 parts of rubber.

Diisocyanates may also be optionally included in the core compositions when utilized, the diioscyanates are included in amounts of from about 0.2 to about 5.0 parts by weight based on 100 parts rubber. Exemplary of suitable diisocyanates is 4,4'-diphenylmethane diisocyanate and other polyfunctional isocyanates know to the art.

Furthermore, the dialkyl tin difatty acids set forth in U.S. Pat. No. 4,844,471, the dispersing agents disclosed in U.S. Pat. No. 4,838,556, and the dithiocarbamates set forth in U.S. Pat. No. 4,852,884 may also be incorporated into the polybutadiene compositions of the present invention. The specific types and amounts of such additives are set forth in the above identified patents, which are incorporated herein by reference.

The core compositions of the invention are generally comprised of 100 parts by weight of a base elastomer (or rubber) selected from polybutadiene and mixtures of polybutadiene with other elastomers, 15 to 25 parts by weight of at least one metallic salt of an unsaturated carboxylic acid, and 1 to 10 parts by weight of a free radical initiator.

As indicated above, additional suitable and compatible modifying agents such as particulate polypropylene resin, fatty acids, and secondary additives such as Pecan. shell flour, ground flash (i.e. grindings from previously manufactured cores of substantially identical construction), barium sulfate, zinc oxide, etc. may be added to the core compositions to adjust the weight of the ball as necessary in order to have the finished molded ball (core, cover and coatings) to closely approach the U.S.G.A. weight limit of 1.620 ounces.

In producing golf ball cores utilizing the present compositions, the ingredients may be intimately mixed using, for example, two roll mills or a Banbury mixer until the composition is uniform, usually over a period of from about 5 to about 20 minutes. The sequence of addition of components is not critical. A preferred blending sequence is as follows.

The elastomer, polypropylene powder resin (if desired), fillers, zinc salt, metal oxide, fatty acid, and the metallic dithiocarbamate (if desired), surfactant (if desired), and tin difatty acid (if desired), are blended for about 7 minutes in an internal mixer such as a Banbury mixer. As a result of shear during mixing, the temperature rises to about 200° F. The initiator and diisocyanate are then added and the mixing continued until the temperature reaches about 220° F. whereupon the batch is discharged onto a two roll mill, mixed for about one minute and sheeted out.

The sheet is rolled into a "pig" and then placed in a Barwell performer and slugs are produced. The slugs are then subjected to compression molding at about 320° F. for about 14 minutes. After molding, the molded cores are cooled, the cooling effected at room temperature for about 4 hours or in cold water for about one hour. The molded cores are subjected to a centerless grinding operation whereby a thin layer of the molded core is removed to produce a round core having a diameter of 1.540 to 1.545 inches. Alternatively, the cores are used in the as-molded state with no grinding needed to achieve roundness.

The mixing is desirably conducted in such a manner that the composition does not reach incipient polymerization temperatures during the blending of the various components.

Usually the curable component of the composition will be cured by heating the composition at elevated temperatures on the order of from about 275° F. to about 350° F., preferably and usually from about 290° F. to about 325° F., with molding of the composition effected simultaneously with the curing thereof. The composition can be formed into a core structure by any one of a variety of molding techniques, e.g. injection, compression, or transfer molding. When the composition is cured by heating, the time required for heating will normally be short, generally from about 10 to about 20 minutes, depending upon the particular curing agent used. Those of ordinary skill in the art relating to free radical curing agents for polymers are conversant with adjustments of cure times and temperatures required to effect optimum results with any specific free radical agent.

After molding, the core is removed from the mold and the surface thereof, preferably treated to facilitate adhesion thereof to the covering materials. Surface treatment can be effected by any of the several techniques known in the art, such as corona discharge, ozone treatment, sand blasting, and the like. Preferably, surface treatment is effected by grinding with an abrasive wheel.

In addition to using solid molded cores, wound cores may also be incorporated in the golf balls of the present invention. Such wound covers would include a generally spherical center and a rubber thread layer, or windings, enclosing the outer surface of the center.

In this regard, the generally spherical center of the wound cores may be a solid center or a liquid center. The solid center can consist of one or more layers. For example, the solid center can comprise a molded polybutadiene rubber sphere which, although smaller in size, is of similar construction to the molded cores in the two-piece molded golf balls described above.

Suitable solid centers used in the invention are not particularly limited to, but include those made of vulcanized rubber. Such solid centers may be prepared by adding to butadiene rubber, additives such as vulcanizing agents, accelerators, activating agents, fillers, modifiers and aids and then subjecting the mixture to vulcanization and molding.

The solid center (whether of single unitary construction or of multi-layers) generally is from 1 to 1.5 inches in diameter, preferably 1.0625 to 1.42 inches, with a weight of 15 grams to 36 grams, preferably 16.5 to 30 grams.

Alternatively, a liquid center can be incorporated into the wound core of the present invention. The liquid center consists of a hollow spherical bag or sack of conventional vulcanized rubber filled with a liquid, paste or gel. Examples of such a liquid include water, glycerin, sugar-water solutions, corn-syrup, saline solutions, oils, etc. and/or combinations thereof. Examples of pastes can be produced by adding clay, sodium sulfate, barytes, barium sulfate to a minor amount of ethylene glycol in water. Examples of suitable gels include hydrogels, cellulose gels, water gels, etc. The specific gravity of the liquid is, in general, 0.6 to 3 and the specific gravity of the paste is from 0.6 to 3 and the gels from 0.6 to 3. The bag or sack is, in general, from 0.05" to 0.150" in thickness, preferably 0.08 to 0.105 inches in thickness.

The liquid center generally is from 1 to 1.25 inches in diameter, preferably 1.0625 to 1.14 inches, with a weight of 5.5 to 25.5 grams, preferably 15 to 21 grams.

The wound core is formed by winding conventional thread rubber around the outer periphery of the solid or liquid center. The thread rubber may include, for example, those prepared by subjecting natural rubber, or a blend of natural rubber and polyisoprene rubber to vulcanization and molding. The winding process is under high tension to produce a threaded layer over the solid or liquid center. Conventional techniques may be employed in winding the thread rubber and known compositions may be used. Although the thread rubber is not limited with respect to specific gravity, dimension and gage, it usually has a specific gravity of 0.9 to 1.1, a width of 0.047 to 0.094 and a gage of 0.012 to 0.026.

The rubber thread layer has a radial thickness of 0.010 to 0.315 inches and comprises a wound core having an outer diameter of 1.52 to 1.63 inches. The overall weight of the wound core is 33 to 44 grams, preferably 35 to 39 grams.

The core is converted into a golf ball by providing at least one layer of covering material thereon, ranging in thickness from about 0.070 to about 0.130 inches and preferably from about 0.0675 to about 0.1275 inches.

As indicated, the golf balls of the present invention may be produced by forming covers consisting of the compositions of the invention around cores by conventional molding processes. For example, in compression molding, the cover composition is formed via injection at about 380° F. to about 450° F. into smooth surfaced hemispherical shells which are then positioned around the core in a dimpled golf ball mold and subjected to compression molding at 200–300° F. for 2–10 minutes, followed by cooling at 50–70° F. for 2–10 minutes, to fuse the shells together to form an unitary ball. In addition, the golf balls may be produced by injection molding, wherein the cover composition is injected directly around the core placed in the center of a golf ball mold for a period of time at a mold temperature of from 50° F. to about 100° F. After molding the golf balls produced may undergo various further processing steps such as buffing, painting, and marking.

A soft, dimpled cover layer preferably is formed from a cover material which has a flex modulus of 20–200 MPa, preferably 20–150 MPa, and more preferably 20–100 MPa. When a blend of hard and soft ionomers is used, the weight ratio of hard to soft ionomer is generally in the range of 3 to 97 and 80 to 20.

Golf balls according to the invention preferably have a PGA compression of 10–110. In a particularly preferred form of the invention, the golf balls have a PGA compression of about 40–100. It has been found that excellent results are obtained when the PGA compression of the golf balls is 60–100. The coefficient of restitution of the golf balls of the invention is in the range of 0.770 or greater. Preferably, the C.O.R. of the golf balls is in the range of 0.770–0.830 and most preferably 0.790–0.830.

As is apparent from the above discussions, two principal properties involved in golf ball performance are resilience and PGA compression. The resilience or coefficient of restitution (C.O.R.) of a golf ball is the constant "e," which is the ratio of the relative velocity of an elastic sphere after direct impact to that before impact. As a result, the C.O.R. ("e") can vary from 0 to 1, with 1 being equivalent to a perfectly or completely elastic collision and 0 being equivalent to a perfectly or completely inelastic collision.

C.O.R., along with additional factors such as club head speed, club head mass, ball weight, ball size and density, spin rate, angle of trajectory and surface configuration (i.e., dimple pattern and area of dimple coverage) as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (C.O.R) of the ball and other factors. The initial velocity of the club, the mass of the club and the angle of the ball's departure are essentially provided by the golfer upon striking. Since club head, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the coefficient of restitution (C.O.R) and the surface configuration (dimple pattern, ratio of land area to dimple area, etc.) of the ball.

The C.O.R of solid core balls is a function of the composition of the core and of the cover. The core and/or cover may be comprised of one or more layers such as in multilayer balls. In balls containing a wound core (i.e., balls comprising a liquid or solid center, elastic windings, and a cover), the coefficient of restitution is a function of not only the composition of the center and cover, but also the composition and tension of the elastomeric windings. As in the solid core balls, the center and cover of a wound core ball may also consist of one or more layers. The C.O.R. of the golf balls of the present invention is a function of the composition and physical properties of the core and cover layer materials such as flex modulus, hardness and particularly, their resilience, i.e. ability to quickly recover from a high impact deformation.

The coefficient of restitution is the ratio of the outgoing velocity to the incoming velocity. In the examples of this application, the coefficient of restitution of a golf ball was measured by propelling a ball horizontally at a speed of 125±5 feet per second (fps) and corrected to 125 fps against a generally vertical, hard, flat steel plate and measuring the ball's incoming and outgoing velocity electronically. Speeds were measured with a pair of Oehler Mark 55 ballistic screens available from Oehler Research, Inc., P.O. Box 9135, Austin, Tex. 78766, which provide a timing pulse when an object passes through them. The screens were separated by 36" and are located 25.25" and 61.25" from the rebound wall. The ball speed was measured by timing the pulses from screen 1 to screen 2 on the way into the rebound wall (as the average speed of the ball over 36"), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel 2.0 inches thick.

As indicated above, the incoming speed should be 125±5 fps but corrected to 125 fps. The correlation between C.O.R. and forward or incoming speed has been studied and a correction has been made over the ±5 fps range so that the C.O.R. is reported as if the ball had an incoming speed of exactly 125.0 fps.

The coefficient of restitution must be carefully controlled in all commercial golf balls if the ball is to be within the specifications regulated by the United States Golf Association (U.S.G.A.). As mentioned to some degree above, the U.S.G.A. standards indicate that a "regulation" ball cannot have an initial velocity exceeding 255 feet per second in an atmosphere of 75° F. when tested on a U.S.G.A. machine. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc.).

PGA compression is another important property involved in the performance of a golf ball. The compression of the ball can affect the playability of the ball on striking and the sound or "click" produced. Similarly, compression can affect the "feel" of the ball (i.e., hard or soft responsive feel), particularly in chipping and putting.

Moreover, while compression itself has little bearing on the distance performance of a ball, compression can affect the playability of the ball on striking. The degree of compression of a ball against the club face and the softness of the cover strongly influences the resultant spin rate. Typically, a softer cover will produce a higher spin rate than a harder cover. Additionally, a harder core will produce a higher spin rate than softer core. This is because at impact a hard core serves to compress the cover of the ball against the face of the club to a much greater degree than a soft core thereby resulting in more "grab" of the ball on the clubface and subsequent higher spin rates. In effect the cover is squeezed between the relatively incompressible core and clubhead. When a softer core is used, the cover is under much less compressive stress than when a harder core is used and therefore does not contact the clubface as intimately. This results in lower spin rates. The term "compression" utilized in the golf ball trade generally defines the overall deflection that a golf ball undergoes when subjected to a compressive load. For example, PGA compression indicates the amount of change in golf ball's shape upon striking.

In the past, PGA compression related to a scale of 0 to 200 given to a golf ball. The lower the PGA compression value, the softer the feel of the ball upon striking. In practice, tournament quality balls have compression ratings around 70–110, preferably around 80 to 100.

In determining PGA compression using the 0–200 scale, a standard force is applied to the external surface of the ball. A ball which exhibits no deflection (0.0 inches in deflection) is rated 200 and a ball which deflects 2/10th of an inch (0.2 inches) is rated 0. Every change of 0.001 of an inch in deflection represents a 1 point drop in compression. Consequently, a ball which deflects 0.1 inches (100×0.001 inches) has a PGA compression value of 100 (i.e., 200–100) and a ball which deflects 0.110 inches (110×0.001 inches) has a PGA compression of 90 (i.e., 200–110).

In order to assist in the determination of compression, several devices have been employed by the industry. For example, PGA compression in determined by an apparatus fashioned in the form of a small press with an upper and lower anvil. The upper anvil is at rest against a 200-pound die spring, and the lower anvil is movable through 0.300 inches by means of a crank mechanism. In its open position the gap between the anvils is 1.780 inches allowing a clearance of 0.100 inches for insertion of the ball. As the lower anvil is raised by the crank, it compresses the ball against the upper anvil, such compression occurring during the last 0.200 inches of stroke of the lower anvil, the ball then loading the upper anvil which in turn loads the spring. The equilibrium point of the upper anvil is measured by a dial micrometer if the anvil is deflected by the ball more than 0.100 inches (less deflection is simply regarded as zero compression) and the reading on the micrometer dial is referred to as the compression of the ball. In practice, tournament quality balls have compression ratings around 80 to 100 which means that the upper anvil was deflected a total of 0.120 to 0.100 inches.

An example to determine PGA compression can be shown by utilizing a golf ball compression tester produced by Atti Engineering Corporation of Newark, N.J. The value obtained by this tester relates to an arbitrary value expressed by a number which may range from 0 to 100, although a value of 200 can be measured as indicated by two revolutions of the dial indicator on the apparatus. The value obtained defines the deflection that a golf ball undergoes when subjected to compressive loading. The Atti test apparatus consists of a lower movable platform and an upper movable spring-loaded anvil. The dial indicator is mounted such that it measures the upward movement of the spring-loaded anvil. The golf ball to be tested is placed in the lower platform, which is then raised a fixed distance. The upper portion of the golf ball comes in contact with and exerts a pressure on the springloaded anvil. Depending upon the distance of the golf ball to be compressed, the upper anvil is forced upward against the spring.

Alternative devices have also been employed to determine compression. For example, Applicant also utilizes a modified Riehle Compression Machine originally produced by Riehle Bros. Testing Machine Company, Phil., Pa. to evaluate compression of the various components (i.e., cores, mantle cover balls, finished balls, etc.) of the golf balls. The Riehle compression device determines deformation in thousandths of an inch under a fixed initialized load of 200 pounds. Using such a device, a Riehle compression of 61 corresponds to a deflection under load of 0.061 inches.

Additionally, an approximate relationship between Riehle compression and PGA compression exists for balls of the same size. It has been determined by Applicant that Riehle compression corresponds to PGA compression by the general formula PGA compression=160-Riehle compression. Consequently, 80 Riehle compression corresponds to 80 PGA compression, 70 Riehle corresponds to 90 PGA compression, and 60 PGA compression corresponds to 100 PGA compression. For reporting purposes, Applicant's compression values are usually measured as Riehle compression and converted to PGA compression.

Furthermore, additional compression devices may also be utilized to monitor golf ball compression so long as the correlation to PGA compression is known. These devices have been designed, such as a Whitney Tester, to correlate or correspond to PGA compression through a set relationship or formula.

As used herein, "Shore D hardness" of a cover is measured generally in accordance with ASTM D-2240, except the measurements are made on the curved surface of a molded cover, rather than on a plaque. Furthermore, the Shore D hardness of the cover is measured while the cover remains over the core. When a hardness measurement is made on a dimpled cover, Shore D hardness is measured at a land area of the dimpled cover.

In this application, Shore D hardness of a cover is measured generally in accordance with ASTM D-2240, except the measurements are made on the curved surface of a molded cover, rather than on a plaque. Furthermore, the Shore D hardness of the cover is measured while the cover remains over the Core. When a hardness measurement is made on a dimpled cover, Shore D hardness is measured at a land area of the dimpled cover.

Golf balls according to the invention have a cut resistance in the range of 1–3 on a scale of 1–5. It is preferred that the golf balls of the invention have a cut resistance of 1–2.5 and most preferably 1–2.

The scuff resistance test was conducted in the following manner: a Top-Flite Tour pitching wedge (1994) with box grooves was obtained and was mounted in a Miyamae driving machine. The club face was oriented for a square hit. The forward/backward tee position was adjusted so that the tee was four inches behind the point in the downswing where the club was vertical. The height of the tee and the toe-heel position of the club relative to the tee were adjusted in order that the center of the impact mark was about ¾ of an inch above the sole and was centered toe to heel across the face. The machine was operated at a clubhead speed of 125 feet per second. Three samples each ball were tested. Each ball was hit three times. After testing, the balls were rated according to the following table:

| Rating | Type of damage |
|---|---|
| 1 | Little or no damage (groove markings or dents) |
| 2 | Small cuts and/or ripples in cover |
| 3 | Moderate amount of material lifted from ball surface but still attached to ball |
| 4 | Material removed or barely attached |

Cut resistance was measured in accordance with the following procedure: A golf ball was fired at 135 feet per second against the leading edge of a 1994 Top-Flite Tour pitching wedge, wherein the leading edge radius is 1/32 inch, the loft angle is 51 degrees, the sole radius is 2.5 inches, and the bounce angle is 7 degrees.

The cut resistance of the balls tested herein was evaluated on a scale of 1–5. A 5 represents a cut that extends completely through the cover to the Core; a 4 represents a cut that does not extend completely through the cover but that does break the surface; a 3 does not break the surface of the cover but does leave a permanent dent; a 2 leaves only a slight crease which is permanent but not as severe as 3; and a 1 represents virtually no visible indentation or damage of any sort.

Figure 2:
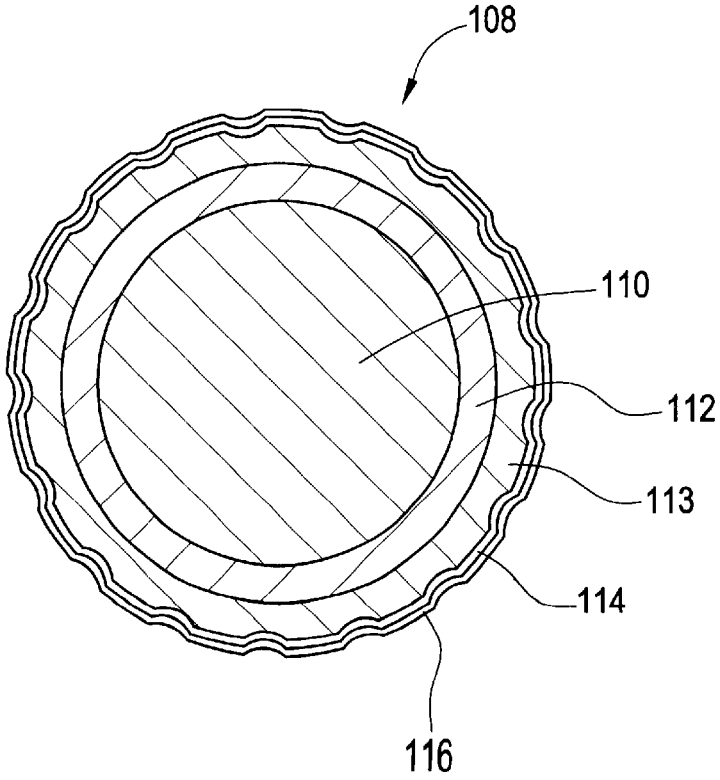
FIG. 2 illustrates a second embodiment of a golf ball according to the present invention.

FIG. 2 shows a further preferred multi-layered embodiment of the invention. The golf ball, which is designated as 108, has a central Core 110, which is a solid, or is formed from any other suitable type of Core composition. An ionomeric inner cover layer 112 surrounds the Core 110. An ionomeric outer cover layer 113 surrounds the inner cover layer 112. A thin primer coat 114 is applied to the outer surface of cover 113. A thin top coat 116 surrounds the primer coat 114. The thicknesses of primer coat 114 and top coat 116 are exaggerated for illustrative purposes.

In the embodiment shown in FIG. 2, the inner and/or outer ionomeric cover layer contains the specific high melt ionomeric blends of the present invention. Preferably, the high melt ionomer blend is present in the outer ionomeric cover layer. However, the present invention is not limited to such combinations as were particularly discussed above.

Having generally described the invention, the following examples are included for purposes of illustration so that the invention may be more readily understood and are in no way intended to limit the scope of the invention unless otherwise specifically indicated.

EXAMPLES

Example 1

Using the ingredients tabled below, golf ball cores having a finished diameter of about 1.540 to about 1.545 inches were produced by compression molding and subsequent removal of a surface layer by grinding. Each core was formulated using 100 parts elastomer (rubber). In the formulations, the amounts of remaining ingredients are expressed in parts by weight, and the weight, degrees of coefficient of restitution and compression (Riehle and/or PGA) achieved are set forth below. The data for these examples are the averages for twelve cores which were produced for each example. The properties of the molded cores produced from each formulation were measured according to the parameters set forth above and/or noted below.

The following core formulations were prepared according to the methods set forth above:

Golf Ball Core Formulation

| MATERIAL | WEIGHT | VOLUME | 100% |
|---|---|---|---|
| Cariflex 1220 (high-cis polybutadiene) | 70 | 76.92 | 37.93 |
| Taktene 220 (high-cis polybutadiene) | 30 | 32.97 | 16.25 |
| Zinc Oxide | 31.5 | 5.67 | 17.07 |
| T.G. Core Regrind | 16 | 13.56 | 8.67 |
| Zinc Stearate | 16 | 14.68 | 8.67 |
| Zinc Diacrylate | 20 | 7.69 | 10.84 |
| OD 0075 Green Masterbatch | 0.15 | 0.10 | .01 |
| 29/40 OR 231XL Peroxide | 0.90 | 0.64 | .49 |
| TOTAL | 184.55 | 153.13 | 100.0 |

| Core Data | Results |
|---|---|
| Size (in.) | 1.545 |
| Weight (g.) | 36.7 |
| PGA Compression | 65 |
| C.O.R. (X 1000) | 790 |
| Shore D hardness | 49 |

The cores were covered with relatively soft, 0.070" inch thick covers formed from several different ionomeric compositions containing various high melt ionomers. Specifically, a dozen golf balls (diameter 1.680 inches) were produced for each formulation as presented below.

| | FORMULATIONS | | | | | |
|---|---|---|---|---|---|---|
| MATERIAL | 1 | 2 | 3 | 4 | 5 | 6 |
| TGMB[1] | 285 | 285 | 285 | 285 | 287 | 287 |
| Iotek 7510 | 1200 | 1200 | 1200 | 1200 | 1710 | 1710 |
| Iotek 7520 | 1200 | 1200 | 1200 | 1200 | | |
| Surlyn ® AD8549 | 315 | | | | | 1003 |
| Surlyn ® AD8660 | | 315 | | | | |
| Surlyn ® AD8940 | | | 315 | | | |
| Iotek 8000 | | | | 315 | 1003 | |

[1]TGMB = Top Grade Masterbatch which consists of 100 parts Iotek 7030, 31.1 parts Unitane 0110, 0.605 Ultra Blue, 0.34 Eastobrite O.B., and 0.05 Santonox R.

Cover formulations 1–4 are representative of Spalding's Top-Flite® Strata formulations, cover formulations 5–6 are representative of Spalding's Top-Flite® Z-Balata formulations and cover formulations 4–5 are controls for the Strata-like and Z-Balata-like constructions, respectively.

The modified balls were then subject to heat distortion evaluation. Specifically, the unfinished balls were heat treated at various temperatures for several different time frames. Heat distortion of the covers was observed visually. Controls were used and the experimental formulations were compared to the controls after all balls were subject to the same thermal history. The maximum temperature selected for testing was 85° C. Distortion effects were also studied at lower temperatures.

In performing the heat distortion analysis, one or more control specimens was placed on a tray with one or more experimental specimens. The tray was then placed in an oven set to the specified temperature. At some time interval (e.g., 20 minutes for 85° C.; 40–60 minutes for 55° C., etc.) the balls were removed and compared visually. If necessary (e.g., to better distinguish the behavior of one formulation versus another), the balls were replaced in the oven and checked again after another time interval. The testing continued until the balls could be ranked relative to one another. The results are reported below:

A. 40 Minutes @ 85° C.

Golf balls covered with Formulations Nos. 1–3 maintained their dimple patterns in comparison to the Top-Flite® Strata control (Formulation No. 4). In addition, the dimple retention of golf ball Formulation No. 1 was better than that of golf ball Formulation Nos. 2–3.

B. 16 Hours @ 88° C.

Golf balls covered with Formulation No. 5 (i.e. the Z-Balata control) exhibited a washed out dimple pattern. In turn, golf balls covered with Formulation No. 6 containing Surlyn® 8549 retained its dimple pattern.

C. 65 Min. @ 88° C.

Utilizing visual inspection, the balls were rated for dimple retention as follows:

Formulation No. 1 (w/Surlyn® 8549)>Formulation No. 2 (w/Surlyn® 8660)>Formulation No. 3 (w/Surlyn® 8940) >Formulation No. 4 (w/lotek 8000, Top-Flite® Strata control)

D. 2.5 Hours @ 77° C.

Utilizing visual inspection, the balls were rated for dimple retention as follows:

Formulation No. 1 (w/Surlyn® 8549)>Formulation No. 2 (w/Surlyn® 8660)>Formulation No. 3 (w/Surlyn® 8940) >Formulation No. 4 (w/lotek 8000, Top-Flite® Strata control)

E. 65 Min @ 86° C.

Utilizing visual inspection, the balls were rated for dimple retention as follows:

Formulation No. 1 (w/Surlyn® 8549)>Formulation No. 2 (w/Surlyn® 8660)>Formulation No. 3 (w/Surlyn® 8940) >Formulation No. 4 (w/lotek 8000, Top-Flite® Strata control)

F. 45 Min @ 86° C.

Utilizing visual inspection, the balls were rated for dimple retention as follows:

Formulation No. 1 (w/Surlyn® 8549)>Formulation No. 2 (w/Surlyn® 8660)>Formulation No. 3 (w/Surlyn® 8940) >Formulation No. 4 (w/lotek 8000, Top-Flite® Strata control).

The above data indicated that soft ionomer cover formulations containing Surlyn® 8549 exhibited improved heat resistance in comparison with other soft ionomer cover formulations utilizing other high melt ionomers.

Example 2

A number of multi-layer golf balls were produced for dimensional stability at elevated temperatures. In this regard, the following mantle and cover stock formulations were produced and molded over the cores utilized above.

| Production Mantle Formulations | Heat Resistant Mantle Formulation | |
|---|---|---|
| 50 parts Iotek 1003 | Iotek 1003 | 2500 g |
| 50 parts Iotek 1002 | Surlyn ® 8549 | 2800 g |
| 100 parts | | 5000 g |
| **Production Cover Formulation** | **Heat Resistant Cover Formulation** | |
| 41 parts Iotek 7510 | Iotek 7510 | 2000 g |
| 41 parts Iotek 7520 | Iotek 7520 | 2000 g |
| 8.5 parts Iotek 8000 | Surlyn ® 8549 | 252 g |
| 9.5 parts TOMB | Top Grade | 475 |
| 100 parts | Master Batch[2] | |
| | | 5000 g |

[2]Top Grade Master Batch consists of Iotek 7030 MB.

Four types of golf balls were then produced (one dozen of each) using the above formulations. These are as follows:

Production Mantle (Prod)/Production (Prod) Cover (Control)

Production (Prod) Mantle/Heat Resistant (Exp) Cover

Heat Resistant (Exp) Mantle/Production (Prod) Cover

Heat Resistant (Exp) Mantle/Heat Resistant (Exp) Cover

The unfinished balls were then evaluated according to the following procedures:

| | | 10 | 11 | 12 | 13 |
|---|---|---|---|---|---|
| Mantle | | exp | exp | prod | prod |
| Cover | | prod | exp | prod | exp |
| As molded balls | | | | | |
| Comp | | 0.0820 | 0.0818 | 0.0820 | 0.0820 |
| (Whitney) | std dev | 0.0018 | 0.0016 | 0.0010 | 0.0014 |
| Comp (Reihle) | | 81 | 78 | 81 | 82 |
| | | 82 | 79 | 82 | 81 |
| | | 82 | 81 | 82 | 82 |
| | | 80 | 86 | 80 | 78 |
| | | 84 | 84 | 83 | 82 |
| | | 83 | 80 | 82 | 80 |
| | | 80 | 80 | 79 | 81 |
| | | 81 | 78 | 82 | 84 |
| | | 81 | 84 | 86 | 85 |
| | | 82 | 81 | 84 | 82 |
| | | 84 | 82 | 81 | 84 |
| | | 81 | 80 | 78 | 79 |
| | average | 81.8 | 81.1 | 81.7 | 81.7 |
| | Std dev | 1.4 | 2.5 | 2.1 | 2.1 |
| C.O.R. | | 0.7703 | 0.7713 | 0.7736 | 0.7727 |
| | std dev | 0.0018 | 0.0028 | 0.0013 | 0.0017 |
| (300 blows) | | 1 @ 47-jamming; 1 @ 300 cutting | jammed causing cut; 1 break at 297 | no failures but jamming due to cutting | no failures |
| Thermal Testing 85° C. for 16 hrs | | pumpkin, but dimple pattern a bit more recognizable than Formulation 10 | best dimple retention | pumpkin | good dimple retention |

Additionally, the above golf balls were then finished (F) with primer and top-coat and the properties of the finished balls were evaluated.

| Comp (W) | 10 (F) | 11 (F) | 12 (F) | 13 (F) |
|---|---|---|---|---|
| Mantle | exp | exp | prod | prod |
| Cover | prod | exp | prod | exp |
| Size (inches) | 1.684 | 1.683 | 1.683 | 1.683 |
| Weight (g) | 44.92 | 44.9 | 44.95 | 44.96 |
| Comp. (W) | 0.08 | 0.079 | 0.08 | 0.08 |
| C.O.R. | 0.7702 | 0.7707 | 0.7727 | 0.7727 |
| Cold Crack | 1 br @ 4<br>1 br @ 5 | no breaks | 2 br @ 4<br>1 br @ 5 | 1 br @ 2<br>1 br @ 3 |

The above results indicate that the heat resistant mantles and covers of the present invention produced excellent melt resistance after severe high temperature exposure, i.e. 16 hours of thermal testing.

Example 3

The below indicated cover formulations were molded over the cores of Example 1 to provide the following results:

| | 20 | 21 | 22 | 23 |
|---|---|---|---|---|
| Materials | | | | |
| Iotek 7510 | 41 | 41 | 41 | 41 |
| Iotek 7520 | 41 | 49.5 | 49.5 | 41 |

-continued

| | 20 | 21 | 22 | 23 |
|---|---|---|---|---|
| Iotek 8000 | 8.5 | | | |
| Surlyn ® 8549 | | | | 8.5 |
| Iotek 7030 MB[3] | 9.5 | 9.5 | | |
| Surlyn ® 8549 MB[4] | | | 9.5 | 9.5 |
| Static Data | | | | |
| size | 1.686 | 1.683 | 1.683 | 1.683 |
| weight | 45.5 | 45.4 | 45.3 | 45.3 |
| comp | 81/82 | 80/81 | 80/80 | 82 |
| C.O.R. | .776 | .775 | .778 | .777 |
| Shore C/D | 75/47 | 72/46 | 73/46–47 | 76/49 |
| Finished Barrel (300 Blow) | no failures | no failures | no failures | no failures |
| Finished Cold Crack | | | | |
| Heat Results | 3rd | 4th | 2nd | 1st |

[3]Iotek 7030 MB = 100 parts Iotek 7030, 31.3 parts Unitane 0110, 0.605 parts Ultra Blue, 0.34 Eastobrite O.B. and 0.05 Santonox R.
[4]Surlyn ® 8549 MB = 100 parts Surlyn ® 8549, 31.3 parts Unithane 0-100, 0.605 Ultra Blue, 0.34 Eastobrite O.B., and 0.05 Santonox R.

The data indicates that the golf ball covered with Surlyn® 8549 exhibited the best dimple retention and heat resistance.

As will be apparent to persons skilled in the art, various modifications and adaptations of the structure above described will become readily apparent without departure from the spirit and scope of the invention, the scope of which is defined in the appended claims.

What is claimed is:

1. A golf ball comprising:

a core, and an ionomeric, dimpled cover formed from a cover material comprising at least 80 parts by weight of terpolymer ionomer and less than 20 parts by weight of a high melt ionomer based upon 100 parts by weight of cover material, said cover having a Shore D hardness of 63 or less as measured on a non-dimpled portion of the cover, the dimples maintaining their shape when the cover is subjected to heat treatment at 71–82° C. for at least one hour.

2. A golf ball according to claim 1, wherein the dimpled cover has a Shore D hardness of 55 or less.

3. A golf ball according to claims 1, wherein the dimpled cover has a Shore D hardness of 50 or less.

4. A golf ball according to claim 1, wherein the dimpled cover comprises a blend of hard and soft ionomers.

5. A golf ball according to claim 4, wherein the ratio of hard to soft ionomer is in the range of 3 to 97 and 80 to 20.

6. A golf ball according to claim 1, wherein the dimpled cover is formed from a cover material having a flex modulus in the range of 20–100 MPa.

7. A golf ball according to claim 1, wherein the dimpled cover is formed directly over the core.

8. A golf ball according to claim 1, wherein the ball has an inner cover beneath the dimpled cover.

9. A golf ball according to claim 1, wherein the ball has an inner cover and an intermediate cover beneath the dimpled cover.

10. A golf ball comprising:

a core; and an ionomeric, dimpled cover having a Shore D hardness of 63 or less as measured on a non-dimpled portion of the cover, wherein said cover comprises a high melt ionomer having a Vicat softening temperature of 74° C. or more, further wherein said cover is formed from a cover material comprising at least 80 parts by weight of a terpolymer ionomer and less than 20 parts by weight of a high melt ionomer based upon 100 parts by weight of cover material.

11. The golf ball of claim 10, wherein said ionomer has a Vicat softening temperature of 80° C. or more.

12. The golf ball of claim 10, wherein said ionomer has a Vicat softening temperature of 84° C. or more.

13. A golf ball comprising:

a core; and an ionomeric, dimpled cover having a Shore D hardness of 63 or less as measured on a non-dimpled portion of the cover, wherein said cover comprises a high melt ionomer having a melt temperature of 96° C. or more, further wherein said cover is formed from a cover material comprising at least 80 parts by weight of a terpolymer ionomer and less than 20 parts by weight of a high melt ionomer based upon 100 parts by weight of cover material.

14. The golf ball of claim 13, wherein said ionomer has a melt temperature of 98° C. or more.

15. The golf ball of claim 13, wherein said ionomer has a melt temperature of 100° C. or more.

16. A golf ball comprising:

a core; and an ionomeric, dimpled cover, wherein said cover comprises a high melt ionomer having exhibiting a difference in melt temperature and Vicat softening temperature of 25° C. or less, further wherein said cover is formed from a cover material comprising at least 80 parts by weight of a terpolymer ionomer and less than 20 parts by weight of a high melt ionomer based upon 100 parts by weight of cover material.

17. The golf ball of claim 16, wherein said ionomer exhibits a difference in melt temperature and Vicat softening temperature of 19° C. or less.

18. The golf ball of claim 16, wherein said ionomer exhibits a difference in melt temperatures and Vicat softening temperature of 17° C. or less.

* * * * *